US010527965B2

(12) United States Patent
Maruko

(10) Patent No.: US 10,527,965 B2
(45) Date of Patent: Jan. 7, 2020

(54) IMAGE FORMING APPARATUS

(71) Applicant: Konica Minolta, Inc., Chiyoda-ku, Tokyo (JP)

(72) Inventor: Masami Maruko, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 38 days.

(21) Appl. No.: 15/792,407

(22) Filed: Oct. 24, 2017

(65) Prior Publication Data

US 2018/0136579 A1 May 17, 2018

(30) Foreign Application Priority Data

Nov. 14, 2016 (JP) ..... 2016-221708

(51) Int. Cl.
*G03G 15/08* (2006.01)

(52) U.S. Cl.
CPC ..... *G03G 15/0813* (2013.01); *G03G 15/0806* (2013.01); *G03G 15/0815* (2013.01); *G03G 2215/0648* (2013.01)

(58) Field of Classification Search
CPC ..... G03G 15/0806; G03G 15/0808; G03G 15/0813; G03G 15/0896; G03G 2215/08; G03G 2215/0634; G03G 2215/0636; G03G 2215/0648; G03G 2215/0855; G03G 2215/0872
See application file for complete search history.

(56) References Cited

U.S. PATENT DOCUMENTS

2007/0280736 A1* 12/2007 Iwamatsu ..... G03G 15/0806 399/222
2013/0195516 A1* 8/2013 Okoshi ..... G03G 15/0813 399/279

FOREIGN PATENT DOCUMENTS

| | | |
|---|---|---|
| JP | 2002-351211 | 12/2002 |
| JP | 2003-307930 | 10/2003 |
| JP | 2013-156364 | 8/2013 |

* cited by examiner

*Primary Examiner* — Thomas S Giampaolo, II
(74) *Attorney, Agent, or Firm* — Squire Patton Boggs (US) LLP

(57) ABSTRACT

An image forming apparatus includes: a photoconductor drum; a developing device having a plurality of developer rollers and supplying toner to the photoconductor drum; a first pressing force applier that applies a force to the developing device to press the plurality of developer rollers toward the photoconductor drum; and a second pressing force applier that flexibly holds the developing device in a vertical direction.

19 Claims, 9 Drawing Sheets

IMAGE FORMING APPARATUS

Japanese Patent Application No. 2016-221708 filed on Nov. 14, 2016, including description, claims, drawings, and abstract the entire disclosure is incorporated herein by reference in its entirety.

BACKGROUND

Technological Field

The present invention relates to an image forming apparatus that transfers and fixes a toner image that is formed on an image carrier to a sheet of paper, and forms an image.

Description of the Related Art

Image forming apparatuses that form images on sheets of paper using toner have been known. In such image forming apparatuses, the surface of a photoconductor drum, which is an image carrier, is charged according to an image and a latent image is formed. In a process called developing, a developing device then deposits toner on the latent image on the photoconductor drum and reveals the latent image to form a toner image The toner image formed on the photoconductor drum is primarily transferred to an intermediate transfer member and is secondarily transferred, at a transfer unit, from the intermediate transfer member to a sheet of paper. The sheet of paper to which the toner image has been transferred is conveyed to a fixing unit, and the toner image is fixed on the sheet of paper by applying heat and pressure.

Configurations are proposed for such image forming apparatuses in which a developing device has two developer rollers that face the photoconductor drum. In image forming apparatuses, it is necessary to ensure a predetermined alignment between the photoconductor drum and the developing device. Thus, a configuration in which one of the two developer rollers can be aligned relative to the photoconductor drum is proposed (see, for example, JP 2003-307930 A).

In addition, a configuration which includes a pressing member that presses the developing device toward the photoconductor drum and a pressing member that presses one of the two developer rollers toward the photoconductor drum is proposed (see, for example, JP 2002-351211 A). Furthermore, a configuration which includes a pressing member that presses the developing device toward the photoconductor drum by restricting the direction of movement of the developing device to a substantially horizontal direction moving toward and away from the photoconductor drum is proposed (see, for example, JP 2013-156364 A).

In the image forming apparatus disclosed in JP 2003-307930 A, when a force is generated in a direction in which the developing device rotates, the developing device rotates and the developer roller that has no abutment becomes misaligned. In the image forming apparatus disclosed in JP 2002-351211 A, the developing device requires a configuration for pressing the developer roller, which complicates the structure. Furthermore, in the image forming apparatus disclosed in JP 2013-156364 A, a reduction in the force for pressing the developing device toward the photoconductor drum makes the alignment of the developer roller relative to the photoconductor drum difficult.

In a conventional image forming apparatus, increasing the force for pressing the developing device toward the photoconductor drum ensures the predetermined alignment between the photoconductor drum and the developer roller. However, increasing the force for pressing the developer roller against the photoconductor drum can deform the photoconductor drum and the developer roller.

SUMMARY

The present invention has been made to solve such problems, and an object of the present invention is to provide an image forming apparatus which is capable of ensuring alignment between a photoconductor drum and a developer roller without increasing the force for pressing a developing device toward the photoconductor drum.

To achieve the abovementioned object, according to an aspect of the present invention, an image forming apparatus reflecting one aspect of the present invention comprises: a photoconductor drum; a developing device having a plurality of developer rollers and supplying toner to the photoconductor drum; a first pressing force applier that applies a force to the developing device to press the plurality of developer rollers toward the photoconductor drum; and a second pressing force applier that flexibly holds the developing device in a vertical direction.

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of an image forming apparatus of the present invention will be described with reference to the drawings. However, the scope of the invention is not limited to the disclosed embodiments.

<An Example Configuration of an Image Forming Apparatus of the Present Embodiment>

Figure 1:
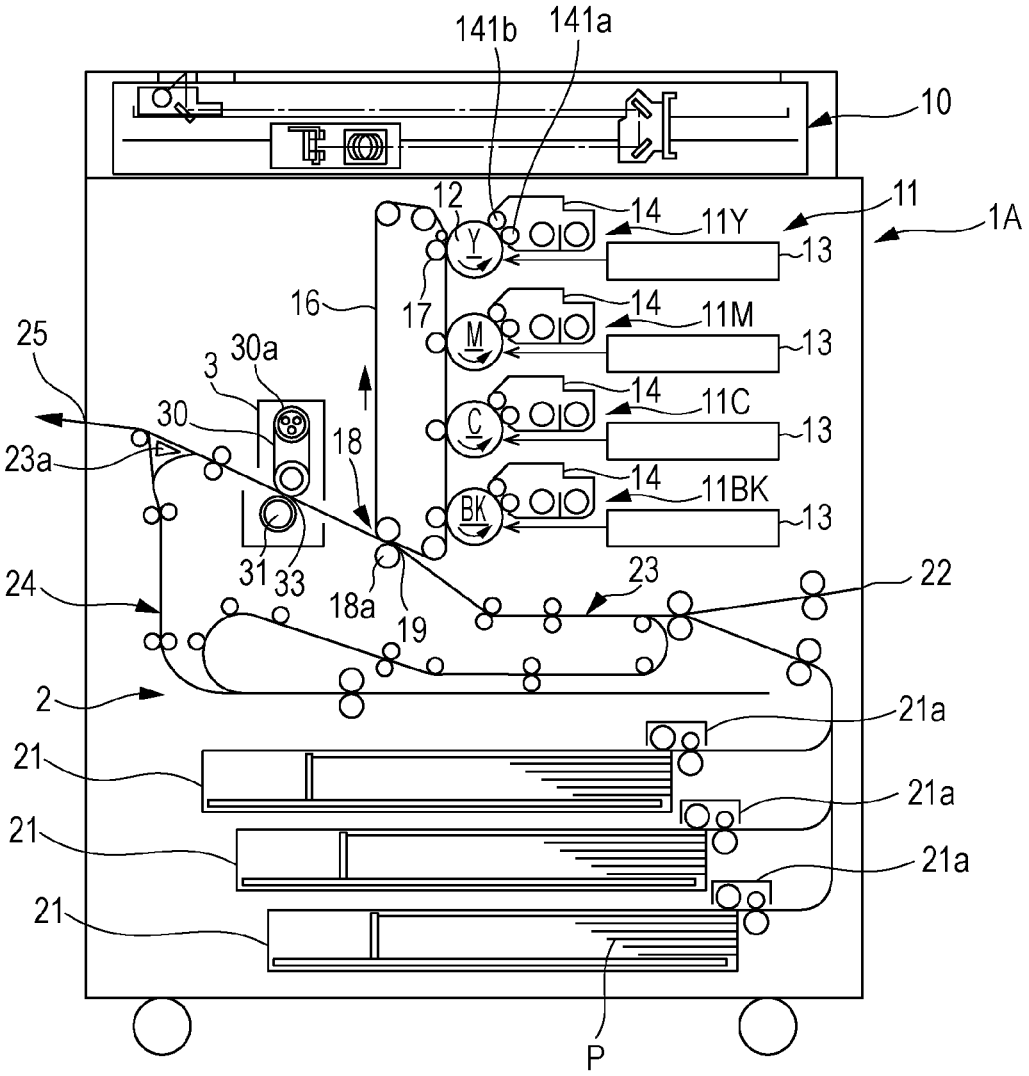
FIG. 1 is a schematic view showing an example of an image forming apparatus of the present embodiment.

FIG. 1 is a schematic view showing an example of an image forming apparatus of the present embodiment. An image forming apparatus 1A of the present embodiment is an electrophotographic image forming apparatus such as a copier, and in this example, is a tandem color image forming apparatus that forms a full color image by having a plurality of photoconductors vertically arranged and facing an intermediate transfer belt.

The image forming apparatus 1A includes an image forming unit 11Y that forms a yellow (Y) image, an image forming unit 11M that forms a magenta (M) image, an image forming unit 11C that forms a cyan (C) image, and an image forming unit 11BK that forms a black (BK) image.

Each of the image forming units 11Y, 11M, 11C, and 11BK is an example of an image forming means, and is provided with a photoconductor drum 12, an optical writing unit 13 that forms a latent image on the photoconductor drum 12, and a developing device 14 that develops the latent image. The photoconductor drum 12 is an example of an image carrier and has the latent image formed thereon due to scan exposing by the optical writing unit 13. The developing device 14 is an example of a developing means and supplies toner to the photoconductor drum 12.

In the image forming units 11Y, 11M, 11C, and 11BK, the toner is supplied from the developing device 14 to the photoconductor drum 12 to develop and visualize the latent image. In the image forming unit 11Y, a yellow toner image is formed on the photoconductor drum 12. In the image forming unit 11M, a magenta toner image is formed on the photoconductor drum 12 as an image of the predetermined color. In the image forming unit 11C, a cyan toner image is formed on the photoconductor drum 12. In the image forming unit 11BK, a black toner image is formed on the photoconductor drum 12.

The image forming apparatus 1A includes an intermediate transfer belt 16 to which the toner images formed on the photoconductor drums 12 are primarily transferred, and primary transfer rollers 17 that transfer the toner images to the intermediate transfer belt 16. The toner image formed on each photoconductor drum 12 is sequentially transferred to a predetermined location on the intermediate transfer belt 16 by each primary transfer roller 17 due to the intermediate transfer belt 16, which is an example of an image carrier and is a belt-shaped intermediate transfer member, being driven in the direction of the arrow.

The image forming apparatus 1A includes a secondary transfer unit 18 that secondarily transfers the toner image formed with all the colors and transferred onto the intermediate transfer belt 16 to a sheet of paper P, or the like. The secondary transfer unit 18 is an example of a transfer means, and is provided with the intermediate transfer belt 16 facing one side of the sheet of paper P and is provided with a secondary transfer roller 18*a* facing another side of the sheet of paper P.

In the secondary transfer unit 18, the secondary transfer roller 18*a*, which is a transfer member, is provided movable in a direction toward and away from the intermediate transfer belt 16, and a transfer nip 19 is formed due to the secondary transfer roller 18*a* being pressed against the intermediate transfer belt 16. In the secondary transfer unit 18, the sheet of paper P is pressed against the intermediate transfer belt 16 at the transfer nip 19 and the secondary transfer roller 18*a* is rotatably driven at the same speed as the intermediate transfer belt 16 to transfer the toner image while conveying the sheet of paper P.

In the secondary transfer unit 18, a positive voltage is applied from the back of the sheet of paper P at the secondary transfer roller 18*a* to transfer the toner image to the sheet of paper P. The sheet of paper P that has passed through the secondary transfer unit 18 is thus charged negatively on an image forming surface to which the toner image is transferred and charged positively on the back.

The image forming apparatus 1A includes a sheet conveying unit 2 that conveys, for example, the sheet of paper P. The image forming apparatus 1A also includes, in this example, a plurality of paper feed trays 21 in which sheets of paper P are stored, paper feed units 21*a* that pay out the sheets of paper P stored in the paper feed trays 21, and an external paper feed port 22 into which sheets of paper, long sheets of paper, or the like are fed from outside.

The sheet conveying unit 2 is an example of a conveying means, and is provided with a main conveyance path 23 that forms a conveyance path of the sheet of paper P that passes through the secondary transfer unit 18, and an inverting conveyance path 24 that forms a conveyance path for turning over the sheet of paper P. Conveyance paths of the sheets of paper P paid out from the paper feed units 21*a* and a conveyance path of the sheets of paper, or the like fed from the external paper feed port 22 join the main conveyance path 23, which connects to an outlet 25.

The inverting conveyance path 24 is a conveyance path that reverses the direction of conveyance of the sheet of paper P to determine the front and back of the sheet of paper P. The sheet conveying unit 2 includes a switching gate 23*a* at a branching point into the main conveyance path 23 and the inverting conveyance path 24 to switch the feed path of the sheet of paper P by an operation of forming an image on opposite sides of the sheet of paper P.

The image forming apparatus 1A includes a fixing unit 3 for fixing the toner image transferred to the sheet of paper P at the secondary transfer unit 18. The fixing unit 3 is an example of a fixing means, and is provided with a fixing belt 30 that heats the sheet of paper P and a pressure roller 31 that presses the sheet of paper P against the fixing belt 30.

At the fixing unit 3, a fixing nip 33 is formed due to the pressure roller 31 being pressed against the fixing belt 30. With the pressure roller 31 pressed against the fixing belt 30, the pressure roller 31 is rotatably driven and a heater 30*a* is turned on so that the sheet of paper P sandwiched at the fixing nip 33 is conveyed and the image on the sheet of paper P is fixed by pressure and heat.

The image forming apparatus 1A includes a document reading unit 10. The document reading unit 10 scan exposes an image of a document by an optical system of a scan exposure device and reads reflected light therefrom with a line image sensor to thereby obtain an image signal. It should be noted that the image forming apparatus 1A may be provided, on a top portion thereof, with an automatic document conveyance device not illustrated for feeding documents.

<An Example Configuration of an Alignment Mechanism for the Developing Device and the Photoconductor Drum of the Present Embodiment>

Figure 2:
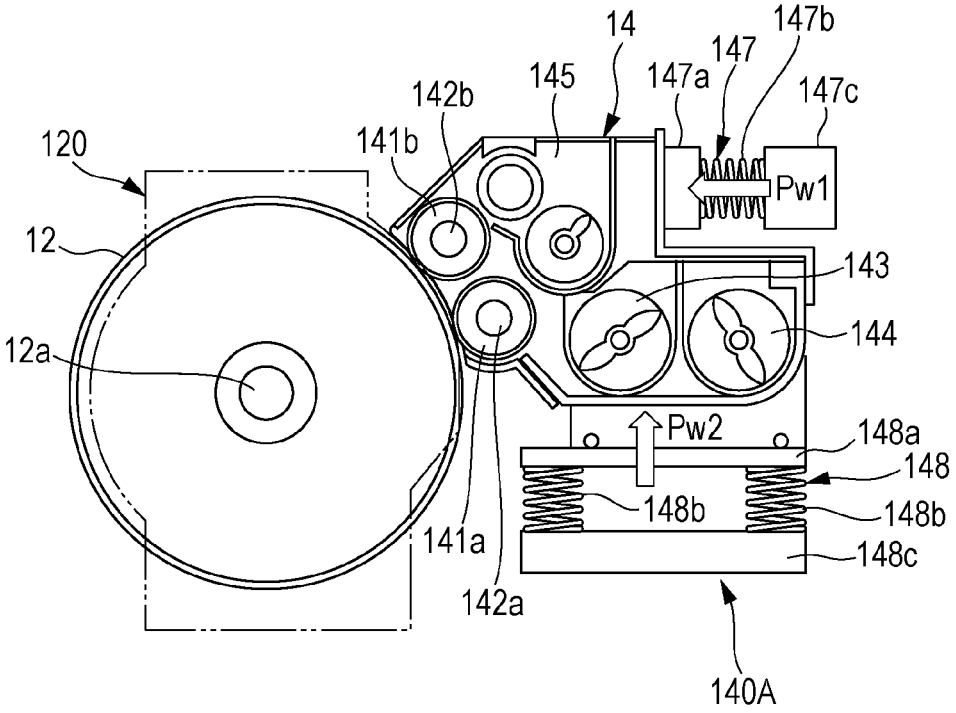
FIG. 2 is a schematic view showing an example of an alignment mechanism of a developing device of the present embodiment.
Figure 3A:
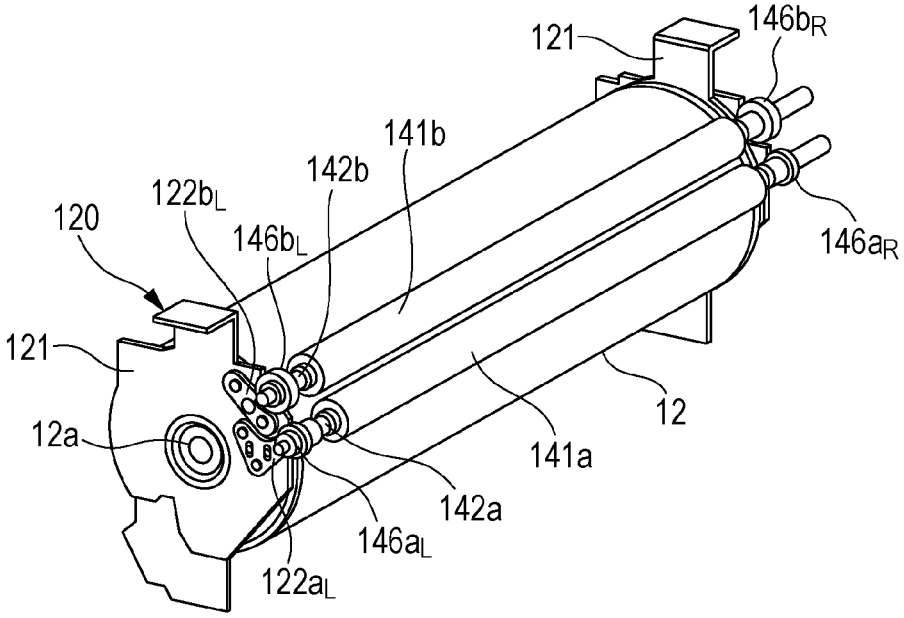
FIGS. 3A and 3B are schematic views showing an example of the alignment mechanism of the developing device of the present embodiment.
Figure 3B:
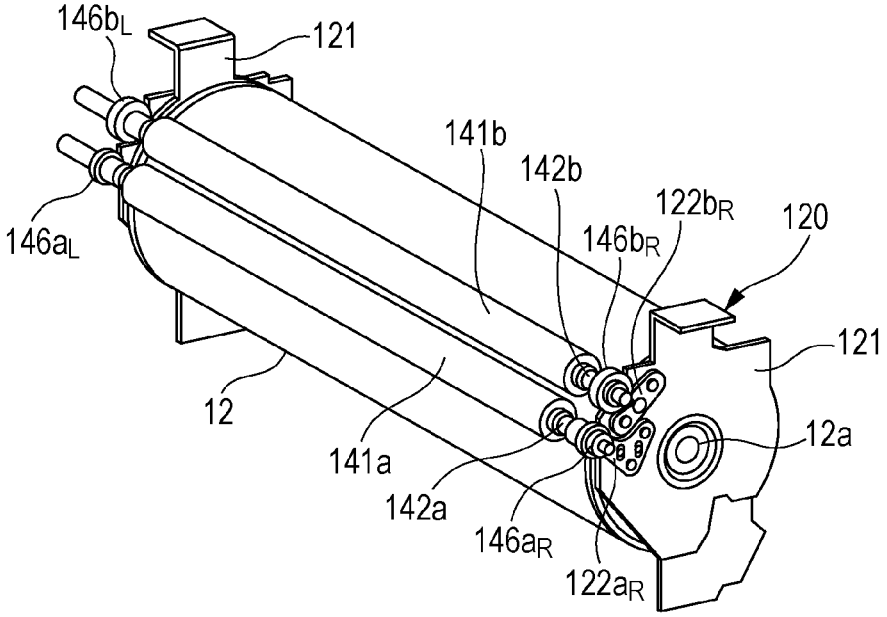

FIGS. 2, 3A, and 3B are schematic views showing an example of an alignment mechanism of the developing device of the present embodiment. An alignment mechanism 140A for the developing device 14 and the photoconductor drum 12 for aligning the developing device 14 with respect to the photoconductor drum 12 will now be described with reference to each drawing.

The developing device 14 includes two developer rollers 141*a*, 141*b*. The first developer roller 141*a* which is one of the developer rollers and the second developer roller 141*b* which is the other developer roller are aligned vertically along a peripheral surface of the photoconductor drum 12, as shown in FIG. 2, in an orientation such that a shaft 142*a* of the first developer roller 141*a* is substantially parallel to a shaft 142*b* of the second developer roller 141*b*. The first developer roller 141*a* and the second developer roller 141*b* thus face the photoconductor drum 12.

The developing device 14 also includes a containing unit 143 that contains a developing agent in which toner and carrier are mixed, a stirring unit 144 that stirs the developing agent, and a recovery unit 145 that recovers the developing agent that has been used for developing. While circulating the developing agent in the containing unit 143 and the stirring unit 144, the developing device 14 supplies the toner in the developing agent to the photoconductor drum 12 by the first developer roller 141*a* and the second developer roller 141*b* which are arranged facing the photoconductor drum 12. Additionally, in the developing device 14, the developing agent that has been used for developing is recovered by the recovery unit 145 and conveyed from the recovery unit 145 to the stirring unit 144. Then, after the toner is supplied thereto, it is used again as the developing agent.

The developing device 14 includes a pair of abutment members 146*a*, 146*b* which define the positions of the first developer roller 141*a* and the second developer roller 141*b* relative to the photoconductor drum 12.

First abutment members $\mathbf{146}a_L$, $\mathbf{146}a_R$, which are a pair of the abutment members that corresponds to the first developer roller 141*a*, are provided on both axial sides of the first developer roller 141*a*. The first abutment members $\mathbf{146}a_L$, $\mathbf{146}a_R$ are formed of a pair of disk-shaped rollers provided coaxial with the first developer roller 141*a*.

The one first abutment member $\mathbf{146}a_L$ is, as shown in FIG. 3A, attached to the shaft 142*a* that projects from one side of the first developer roller 141*a*. The other first abutment member $\mathbf{146}a_R$ is, as shown in FIG. 3B, attached to the shaft 142*a* that projects from another side of the first developer roller 141*a*.

Second abutment members $\mathbf{146}b_L$, $\mathbf{146}b_R$, which are a pair of the abutment members that corresponds to the second developer roller 141*b*, are provided on both axial sides of the second developer roller 141*b*. The second abutment members $\mathbf{146}b_L$, $\mathbf{146}b_R$ are formed of a pair of disk-shaped rollers provided coaxial with the second developer roller 141*b*.

The one second abutment member $\mathbf{146}b_L$ is, as shown in FIG. 3A, attached to the shaft 142*b* that projects from one side of the second developer roller 141*b*. The other second abutment member $\mathbf{146}b_R$ is, as shown in FIG. 3B, attached to the shaft 142*b* that projects from another side of the second developer roller 141*b*.

The photoconductor drum 12 is attached to housings 121 that constitute a photoconductor unit 120, which is a photoconductor device. The photoconductor unit 120 has the housings 121 provided on both axial sides of the photoconductor drum 12 and rotatably supports both ends of a shaft 12*a* of the photoconductor drum 12 through a device for supporting a shaft, such as a bearing.

The photoconductor unit 120 includes a pair of abutted members 122*a*, 122*b* against which the pair of abutment members 146*a*, 146*b* are abutted. First abutted members $\mathbf{122}a_L$, $\mathbf{122}a_R$, which are a pair of the abutted members that corresponds to the first abutment member 146*a*, are provided on respective side surfaces of the housings 121 of the photoconductor unit 120. The one first abutment member $\mathbf{146}a_L$ of the developing device 14 is abutted against the one first abutted member $\mathbf{122}a_L$, and the other first abutment member $\mathbf{146}a_R$ of the developing device 14 is abutted against the other first abutted member $\mathbf{122}a_R$.

Second abutted members $\mathbf{122}b_L$, $\mathbf{122}b_R$, which are a pair of the abutted members that corresponds to the second abutment member 146*b*, are provided on respective side surfaces of the housings 121 of the photoconductor unit 120. The one second abutment member $\mathbf{146}b_L$ of the developing device 14 is abutted against the one second abutted member $\mathbf{122}b_L$, and the other second abutment member $\mathbf{146}b_R$ of the developing device 14 is abutted against the other second abutted member $\mathbf{122}b_R$.

The alignment mechanism 140A includes a first pressing force applying unit 147 that pushes the developing device 14 with a first force Pw1 in a first direction along a horizontal direction, which is a direction in which the first developer roller 141*a* and the second developer roller 141*b* are pressed against the photoconductor drum 12.

The first pressing force applying unit 147 is an example of a first pressing force applier, and is provided with a pressing member 147*a* that presses the developing device 14, a spring 147*b* that applies a force to the pressing member 147*a*, and a support member 147*c* that supports the spring 147*b* on the image forming apparatus 1A. The spring 147*b* is an example of a biasing means and is a coil spring in this example.

The alignment mechanism 140A also includes a second pressing force applying unit 148 that pushes the developing device 14 with a second force Pw2 in a second direction which intersects an acting direction of the first force Pw1 and is opposite the direction of gravity.

The second pressing force applying unit 148 is an example of a second pressing force applier, and is provided with a mounting member 148*a* on which the developing device 14 is mounted, a spring 148*b* that applies a force to the mounting member 148*a*, and a support member 148*c* that supports the spring 148*b* on the image forming apparatus 1A. The spring 148*b* is an example of a biasing means and is a coil spring in this example.

<Example Effects of Action of the Alignment Mechanism for the Developing Device and the Photoconductor Drum of the Present Embodiment>

The developing device 14 is attached to the image forming apparatus 1A by being mounted on the mounting member 148*a* so that the pressing member 147*a* contacts the developing device 14 with the spring 147*b* in a compressed state. The developing device 14 is thus pressed with the first force Pw1 in the first direction by the spring 147*b* of the first pressing force applying unit 147.

Consequently, in correspondence with the first developer roller 141*a*, the first abutment member $\mathbf{146}a_L$ abuts against the first abutted member $\mathbf{122}a_L$ of the photoconductor unit 120, and the first abutment member $\mathbf{146}a_R$ abuts against the first abutted member $\mathbf{122}a_R$ thereof.

Furthermore, in correspondence with the second developer roller 141*b*, the second abutment member 146$b_L$ abuts against the second abutted member 122$b_L$ of the photoconductor unit 120, and the second abutment member 146$b_R$ abuts against the second abutted member 122$b_R$ thereof.

In the developing device 14, the pair of first abutment members 146$a_L$,146$a_R$ that is provided coaxial with the first developer roller 141*a* abuts against the first abutted members 122$a_L$, 122$a_R$ to ensure parallelism between the photoconductor drum 12 and the first developer roller 141*a*.

Furthermore, the pair of second abutment members 146$b_L$,146$b_R$ that is provided coaxial with the second developer roller 141*b* abuts against the second abutted members 122$b_L$, 122$b_R$ to ensure parallelism between the photoconductor drum 12 and the second developer roller 141*b*.

The developing device 14 is attached to the image forming apparatus 1A by being mounted on the mounting member 148*a* so that the spring 148*b* is in a compressed state due to the dead weight of the developing device 14. The developing device 14 is thus pressed with the second force Pw2 in the second direction by the spring 148*b* of the second pressing force applying unit 148.

The second force Pw2 acts in a direction opposite the direction of gravity. Thus, the developing device 14 is pressed with the second force Pw2 in the second direction by the second pressing force applying unit 148 so that the weight of the developing device 14 is reduced.

As a result, compared to a case where no second force Pw2 is applied, the first force Pw1 for abutting the total of four abutment members 146*a*, 146*b* that are provided on both sides of each of the two developer rollers 141*a*, 141*b* against the respective facing abutted members 122*a*, 122*b* can be reduced.

Increasing the first force for abutting the abutment members against the abutted members may cause the developer rollers 141*a*, 141*b* and the photoconductor drum 12 to deform. In contrast, being able to reduce the first force Pw1 compared to the case where no second force Pw2 is applied suppresses an increase in a load from the first force Pw1 and ensures parallelism between the two developer rollers 141*a*, 141*b* and the photoconductor drum 12.

It should be noted that forming the first abutment members 146$a_L$, 146$a_R$ and the second abutment members 146$b_L$, 146$b_R$ as rotatable rollers suppresses damage to the photoconductor drum 12 in a configuration in which the photoconductor drum 12 itself is the abutted member. Additionally, processing accuracy can be easily improved for circular rollers.

<A variation of the Alignment Mechanism for the Developing Device and the Photoconductor Drum of the Present Embodiment>

Figure 4:
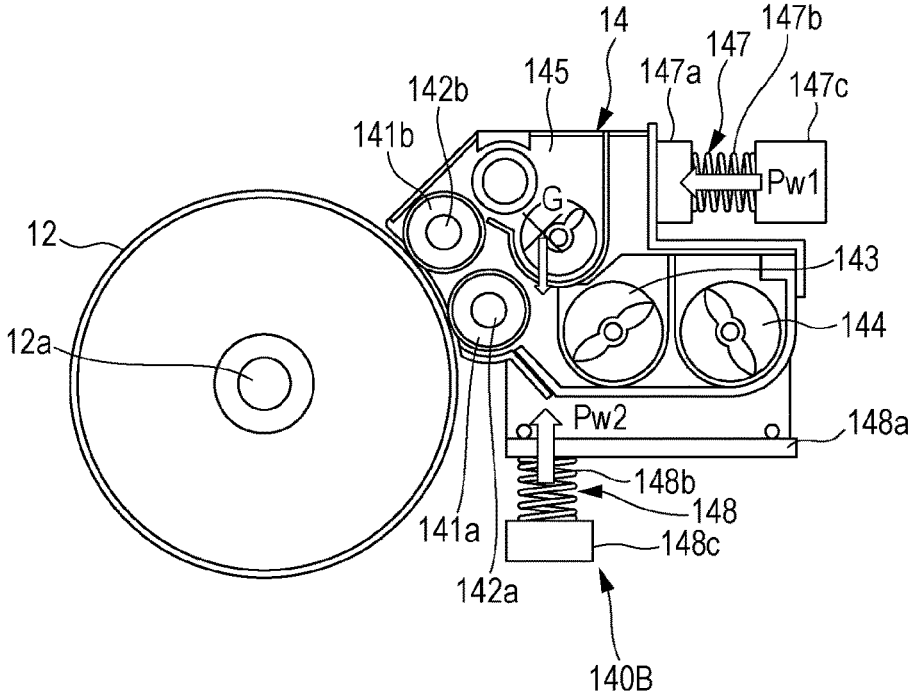
FIG. 4 is a schematic view showing a variation of the alignment mechanism of the developing device of the present embodiment.

FIG. 4 is a schematic view showing a variation of the alignment mechanism of the developing device of the present embodiment. In an alignment mechanism 140B, the position, and the like of the spring 148*b* of the second pressing force applying unit 148 are set such that the second force Pw2 can be applied to the center of gravity G of the developing device 14 from vertically below.

Applying the second force Pw2 from vertically below the center of gravity G of the developing device 14 suppresses generation of a force that causes the developing device 14 to tilt in a front to back direction. Thus, the front to back balance of the developing device 14 that is mounted on the mounting member 148*a* is maintained and the weight of the developing device 14 is stably reduced. Consequently, the force for abutting the first developer roller 141*a* and the second developer roller 141*b* against the photoconductor drum 12 with the first force Pw1 is controlled easily.

Figure 5:
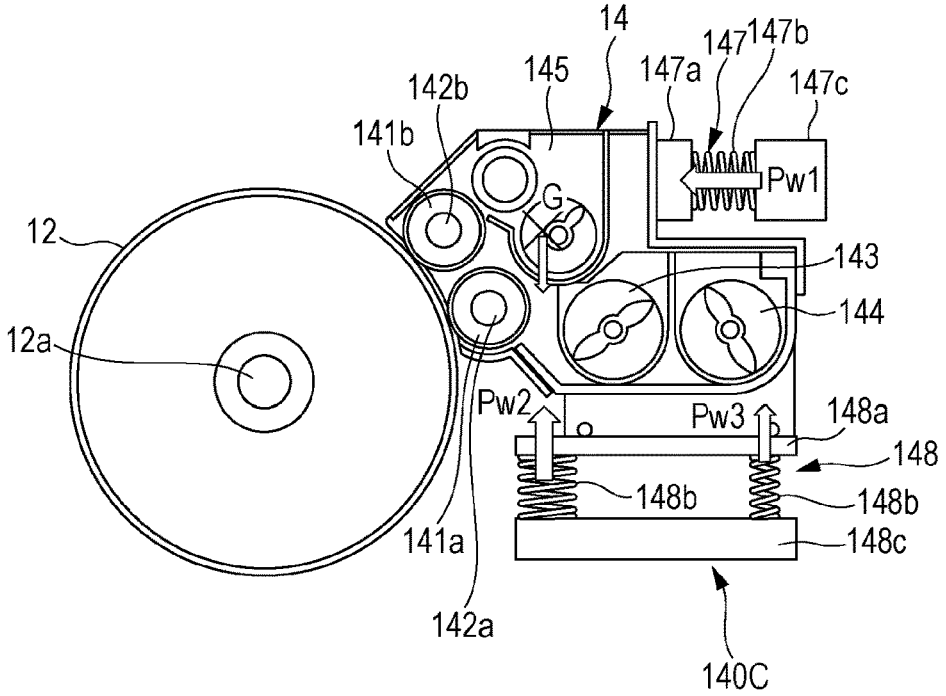
FIG. 5 is a schematic view showing a variation of the alignment mechanism of the developing device of the present embodiment.

FIG. 5 is a schematic view showing a variation of the alignment mechanism of the developing device of the present embodiment. In an alignment mechanism 140C, the position, and the like, of the spring 148*b* of the second pressing force applying unit 148 are set such that the second force Pw2 is applied to the center of gravity G of the developing device 14 from vertically below and a third force Pw3, which acts in a direction parallel to that of the second force Pw2 and is smaller than the second force Pw2, can be applied to a predetermined position on the opposite side of the first developer roller 141*a* and the second developer roller 141*b* with respect to the center of gravity G of the developing device 14.

Applying the second force Pw2 from vertically below the center of gravity G of the developing device 14 suppresses generation of a force that causes the developing device 14 to tilt in a front to back direction. However, the front to back balance of the developing device 14 that is mounted on the mounting member 148*a* is unstable due to, for example, movement of the developing agent, and rotation of the developer rollers or a stirrer screw.

Accordingly, the third force Pw3 is applied to the predetermined position on the opposite side of the first developer roller 141*a* and the second developer roller 141*b* with respect to the center of gravity G. A force for rotating the entire developing device 14 is thus applied in a direction to move the first developer roller 141*a* and the second developer roller 141*b* toward the photoconductor drum 12.

As a result, even when the front to back balance of the developing device 14 is unstable, the first abutment members 146$a_L$, 146$a_R$, shown in FIGS. 3A and 3B, are kept abutted against the first abutted members 122$a_L$, 122$a_R$, and the second abutment members 146$b_L$, 146$b_R$ are kept abutted against the second abutted members 122$b_L$, 122$b_R$.

Figure 6:
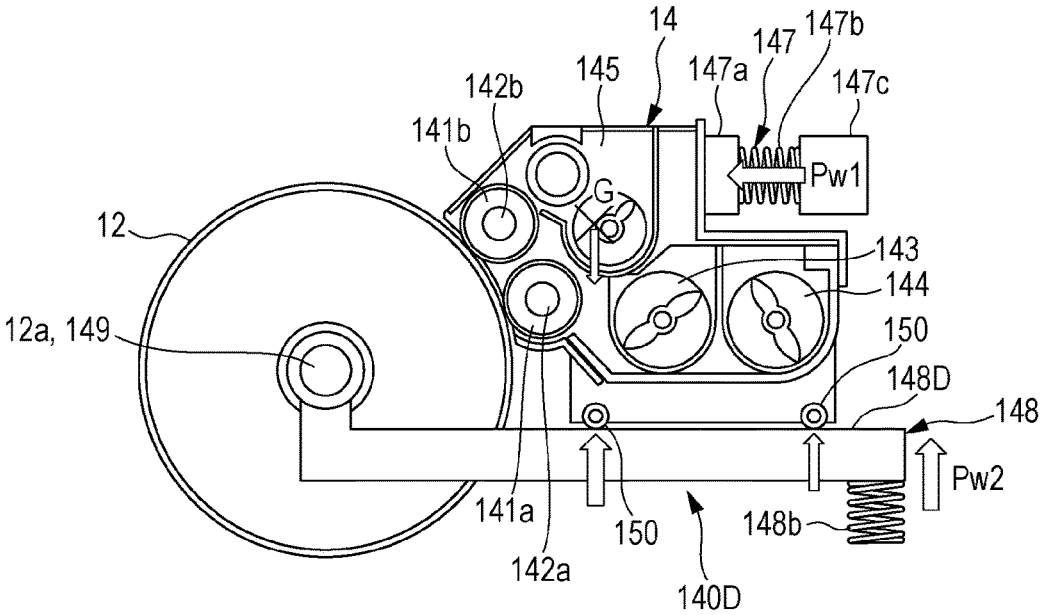
FIG. 6 is a schematic view showing a variation of the alignment mechanism of the developing device of the present embodiment.

FIG. 6 is a schematic view showing a variation of the alignment mechanism of the developing device of the present embodiment. In an alignment mechanism 140D, the second pressing force applying unit 148 is rotatably supported by a shaft 149 on a side of the photoconductor drum 12 and includes a mounting member 148D that extends to the opposite side of the first developer roller 141*a* and the second developer roller 141*b* with respect to the center of gravity G of the developing device 14.

The second pressing force applying unit 148 movably supports the developing device 14 in a vertical direction by rotational operation of the mounting member 148D about the shaft 149 provided on the side of the photoconductor drum 12. The shaft 149 is preferably provided coaxial with the shaft 12*a* of the photoconductor drum 12.

Portions of the first abutted members 122$a_L$, 122$a_R$ and the second abutted members 122$b_L$, 122$b_R$, shown in FIGS. 3A and 3B, against which the first abutment members 146$a_L$, 146$a_R$ and the second abutment members 146$b_L$, 146$b_R$ are abutted have an arc shape centered on the shaft 12*a* of the photoconductor drum 12.

The developing device 14 includes rotatable rollers 150 on a bottom face that contacts the mounting member 148D. The rollers 150 are an example of a rotatable support member, and are provided rotatable along a pressing direction of the developing device 14 by the first force Pw1 to reduce movement load of the developing device 14 along the pressing direction of the first force Pw1. The rollers 150 are provided vertically below the center of gravity G of the developing device 14 and on the opposite side of the first developer roller 141*a* and the second developer roller 141*b* with respect to the center of gravity G.

The second force Pw2 is applied by the spring 148*b* to the mounting member 148D at an end thereof on the opposite side of the first developer roller 141*a* and the second developer roller 141*b* with respect to the center of gravity G of the developing device 14.

In the alignment mechanism 140D, the developing device 14 is movably supported in a vertical direction by rotational operation of the mounting member 148D about the shaft 149 provided on the side of the photoconductor drum 12. The direction in which the first developer roller 141*a* and the second developer roller 141*b* move by the pressing of the second force Pw2 is a direction along the photoconductor drum 12.

In addition, the pressing by the first force Pw1 causes the first abutment members 146$a_L$, 146$a_R$, shown in FIGS. 3A and 3B, to abut against the first abutted members 122$a_L$, 122$a_R$ and the second abutment members 146$b_L$, 146$b_R$ to abut against the second abutted members 122$b_L$, 122$b_R$.

Thus, the pressing by the first force Pw1 and the second force Pw2 prevents the first developer roller 141*a* and the second developer roller 141*b* from moving in a direction away from the photoconductor drum 12.

The second force Pw2 is applied to the mounting member 148D an end thereof on the opposite side of the first developer roller 141*a* and the second developer roller 141*b* with respect to the center of gravity G of the developing device 14. Thus, the power applied from vertically below the center of gravity G of the developing device 14 suppresses generation of the force that causes the developing device 14 to tilt in the front to back direction.

In addition, the power applied to the developing device 14 from below on the opposite side of the first developer roller 141*a* and the second developer roller 141*b* with respect to the center of gravity G of the developing device 14 is smaller than the power applied to the developing device 14 from vertically below the center of gravity G of the developing device 14.

A force for rotating the entire developing device 14 is thus applied in a direction to move the first developer roller 141*a* and the second developer roller 141*b* toward the photoconductor drum 12.

As a result, even when the front to back balance of the developing device 14 is unstable, the first abutment members 146$a_L$, 146$a_R$, shown in FIGS. 3A and 3B, are kept abutted against the first abutted members 122$a_L$, 122$a_R$, and the second abutment members 146$b_L$, 146$b_R$ are kept abutted against the second abutted members 122$b_L$, 122$b_R$. This ensures the parallelism between the first and second developer rollers 141*a*, 141*b* and the photoconductor drum 12.

It should be noted that by forming the mounting member 148D as independent components on both sides of the developing device 14 in a left to right direction, the mounting member 148D is capable of following the tilt of the shaft 142*a* of the first developer roller 141*a*, the shaft 142*b* of the second developer roller 141*b*, and the shaft 12*a* of the photoconductor drum 12.

Figure 7:
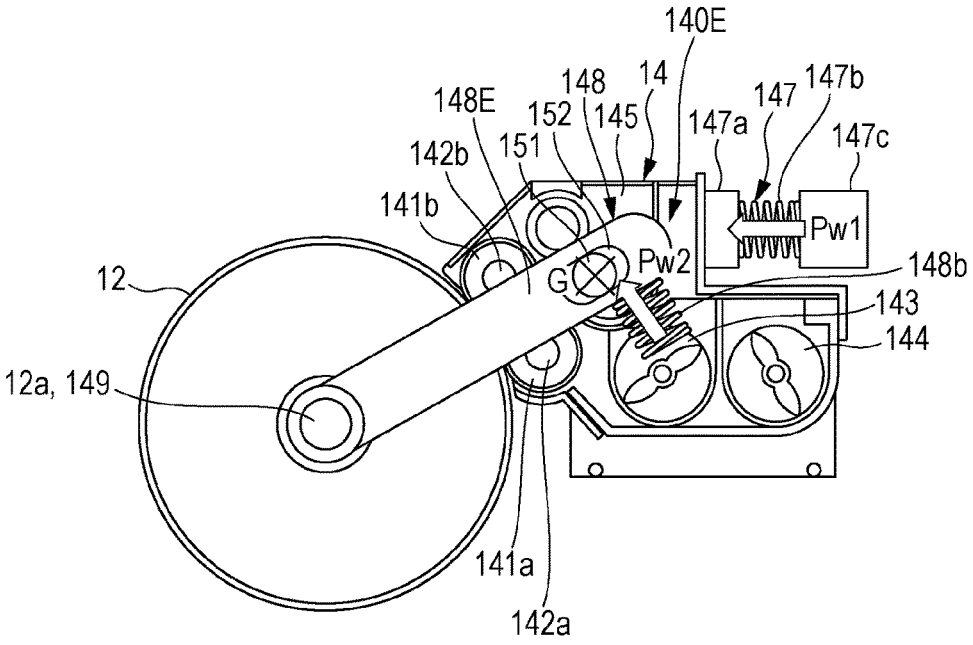
FIG. 7 is a schematic view showing a variation of the alignment mechanism of the developing device of the present embodiment.

FIG. 7 is a schematic view showing a variation of the alignment mechanism of the developing device of the present embodiment. In an alignment mechanism 140E, the second pressing force applying unit 148 is rotatably supported by the shaft 149 on the side of the photoconductor drum 12 and includes a mounting member 148E that extends to the center of gravity G of the developing device 14.

The second pressing force applying unit 148 movably supports the developing device 14 in the vertical direction by rotational operation of the mounting member 148E about the shaft 149 provided on the side of the photoconductor drum 12. The shaft 149 is preferably provided coaxial with the shaft 12*a* of the photoconductor drum 12.

Portions of the first abutted members 122$a_L$, 122$a_R$ and the second abutted members 122$b_L$, 122$b_R$, shown in FIGS. 3A and 3B, against which the first abutment members 146$a_L$, 146$a_R$ and the second abutment members 146$b_L$, 146$b_R$ are abutted have an arc shape centered on the shaft 12*a* of the photoconductor drum 12.

The developing device 14 includes a support shaft 151 at the center of gravity G. The mounting member 148E includes a hole 152 through which the support shaft 151 extends. The hole 152 has a slot shape that extends along the mounting member 148E and movably supports the developing device 14 along the pressing direction of the first force Pw1.

The second force Pw2 is applied by the spring 148*b* to the mounting member 148E at an end thereof on the opposite side of the first developer roller 141*a* and the second developer roller 141*b* with respect to the center of gravity G of the developing device 14.

In the alignment mechanism 140E, the developing device 14 is movably supported in the vertical direction by rotational operation of the mounting member 148E about the shaft 149 provided on the side of the photoconductor drum 12. The direction in which the first developer roller 141*a* and the second developer roller 141*b* move by the pressing of the second force Pw2 is a direction along the photoconductor drum 12.

In addition, the pressing by the first force Pw1 causes the first abutment members 146$a_L$, 146$a_R$, shown in FIGS. 3A and 3B, to abut against the first abutted members 122$a_L$, 122$a_R$ and the second abutment members 146$b_L$, 146$b_R$ to abut against the second abutted members 122$b_L$, 122$b_R$.

Thus, the pressing by the first force Pw1 and the second force Pw2 prevents the first developer roller 141*a* and the second developer roller 141*b* from moving in a direction away from the photoconductor drum 12.

Furthermore, since the second force Pw2 is applied to the center of gravity G of the developing device 14, generation of a force that causes the developing device 14 to tilt in the front to back direction is suppressed. Thus, the first abutment members 146$a_L$, 146$a_R$ are kept abutted against the first abutted members 122$a_L$, 122$a_R$, and the second abutment members 146$b_L$, 146$b_R$ are kept abutted against the second abutted members 122$b_L$, 122$b_R$. This ensures the parallelism between the first and second developer rollers 141*a*, 141*b* and the photoconductor drum 12.

It should be noted that by providing the support shaft 151 on both the left and right sides of the developing device 14 and by forming the mounting member 148E as independent components on both sides of the developing device 14 in the left to right direction, the mounting member 148E is capable of following the tilt of the shaft 142*a* of the first developer roller 141*a*, the shaft 142*b* of the second developer roller 141*b*, and the shaft 12*a* of the photoconductor drum 12.

Figure 8A:
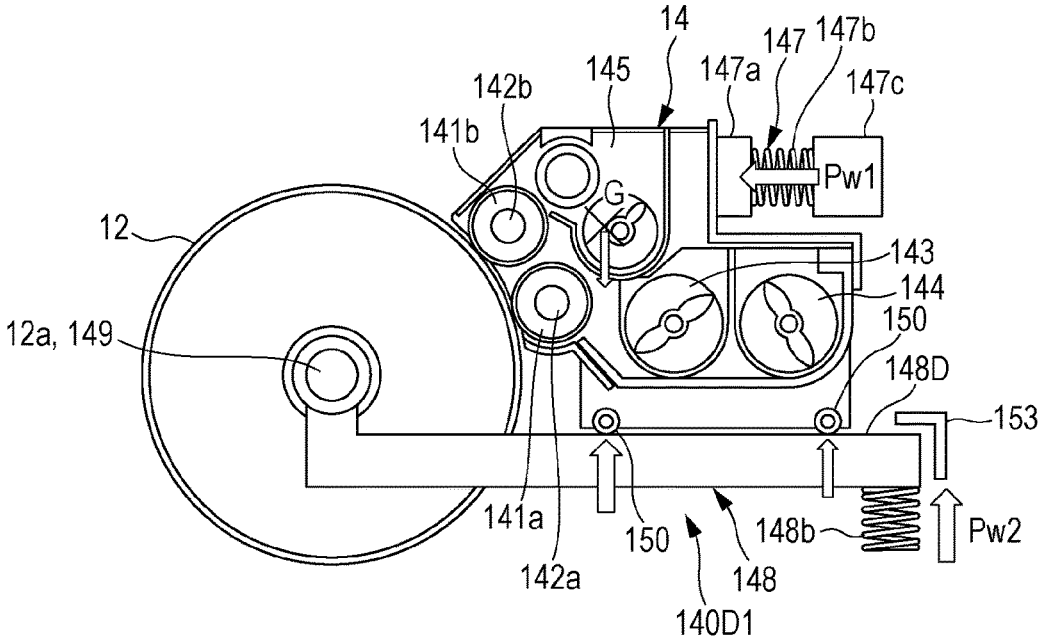
FIGS. 8A and 8B are schematic views showing variations of the alignment mechanism of the developing device of the present embodiment.
Figure 8B:
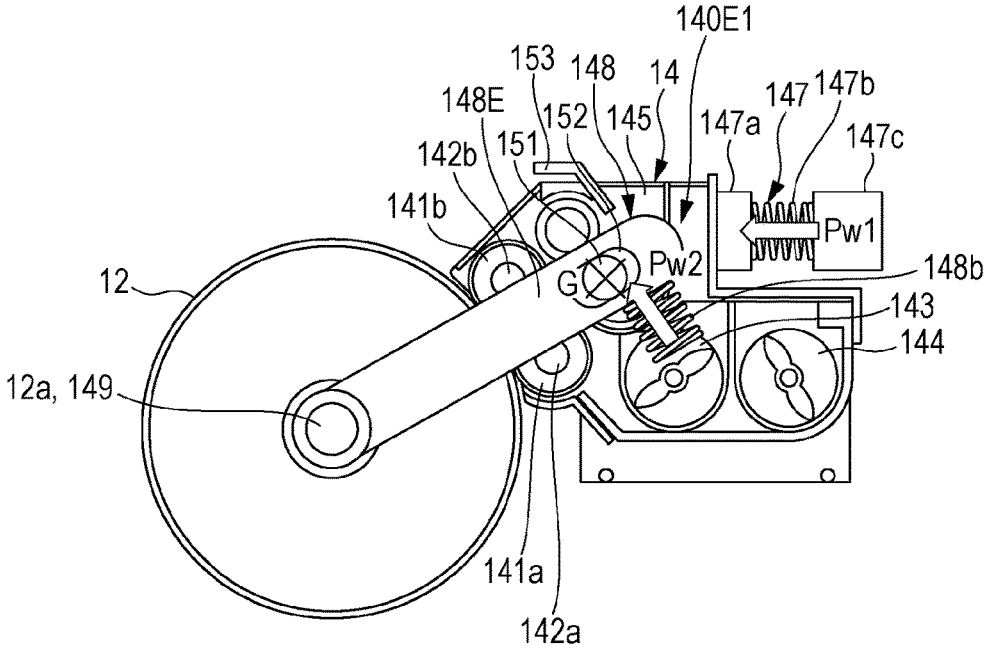

FIGS. 8A and 8B are schematic views showing variations of the alignment mechanism of the developing device of the present embodiment. An alignment mechanism 140D1 shown in FIG. 8A includes a stopper 153 that restricts an amount of movement of the mounting member 148D by the second force Pw2 in the alignment mechanism 140D described in FIG. 6. An alignment mechanism 140E1 shown in FIG. 8B includes the stopper 153 that restricts the amount of movement of the mounting member 148E by the second force Pw2 in the alignment mechanism 140E described in FIG. 7.

When the developing device 14 is removed from the image forming apparatus 1A shown in FIG. 1, space necessary for mounting the developing device 14 is provided due to restriction of the amount of movement of the mounting members 148D, 148E by the second force Pw2. This facilitates the mounting of the developing device 14.

In addition, when the weight of the developing device 14 is reduced due to a decrease in the amount of the developing agent by consumption of the toner, restriction of the amount of movement of the mounting members 148D, 148E by the second force Pw2 prevents large misalignment of the developing device 14 and suppresses deviation in the parallelism between the first and second developer rollers 141*a*, 141*b* and the photoconductor drum 12.

Figure 9A:
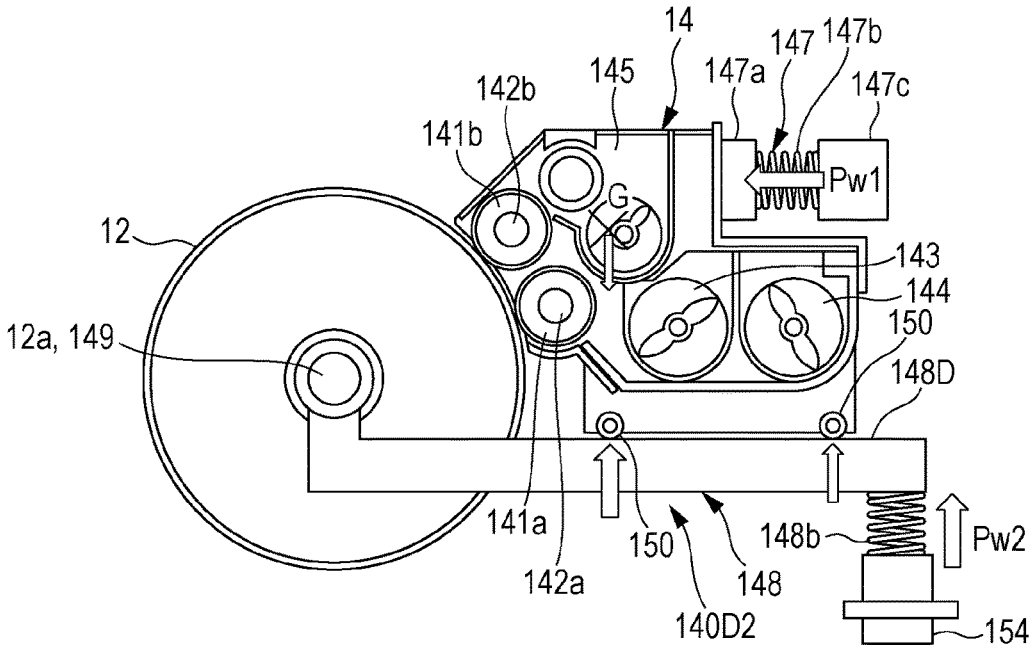
FIGS. 9A and 9B are schematic views showing variations of the alignment mechanism of the developing device of the present embodiment.
Figure 9B:
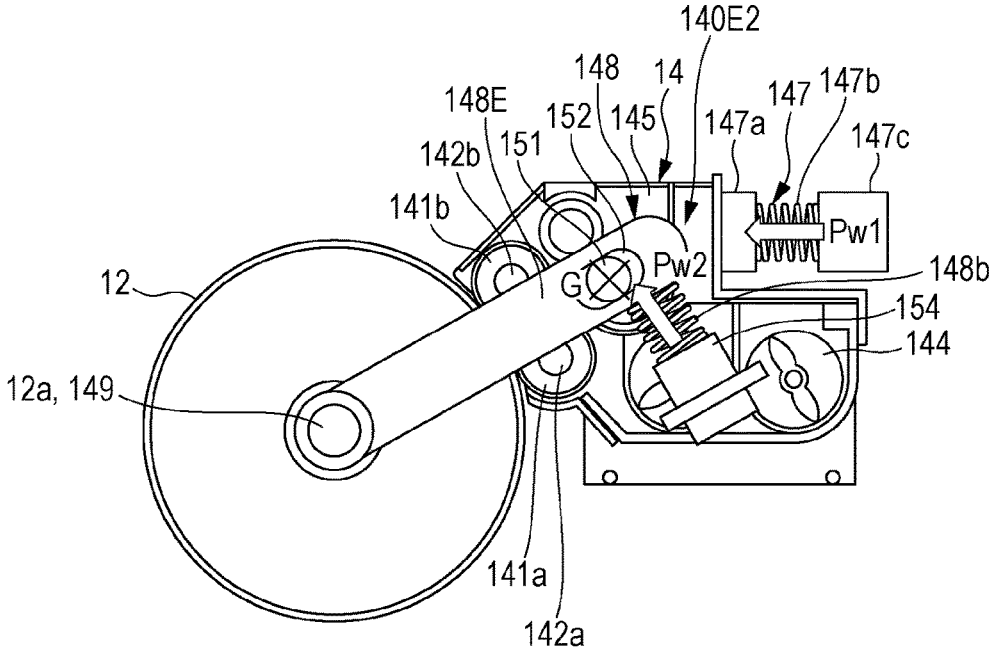

FIGS. 9A and 9B are schematic views showing variations of the alignment mechanism of the developing device of the present embodiment. An alignment mechanism 140D2 shown in FIG. 9A includes an adjustment mechanism 154 that varies the amount of the second force Pw2 in the alignment mechanism 140D described in FIG. 6. An alignment mechanism 140E2 shown in FIG. 9B includes the adjustment mechanism 154 that varies the amount of the second force Pw2 in the alignment mechanism 140E described in FIG. 7. The adjustment mechanism 154 is an example of an adjustment means, and is capable of adjusting the left-right position of the developing device 14 by enabling the acting position of the spring 148*b* to be adjusted by utilizing, for example, the amount of projection of a screw.

This enables the developing device 14 to be adjusted to an ideal position in the left-right position and suppresses deficiency and excess in the first force Pw1 for abutting the first abutment members 146$a_L$, 146$a_R$, shown in FIGS. 3A and 3B, against the first abutted members 122$a_L$, 122$a_R$, and the second abutment members 146$b_L$, 146$b_R$ against the second abutted members 122$b_L$, 122$b_R$. Thus, the parallelism between the first and second developer rollers 141*a*, 141*b* and the photoconductor drum 12 is maintained in a set desired state.

Figure 10:
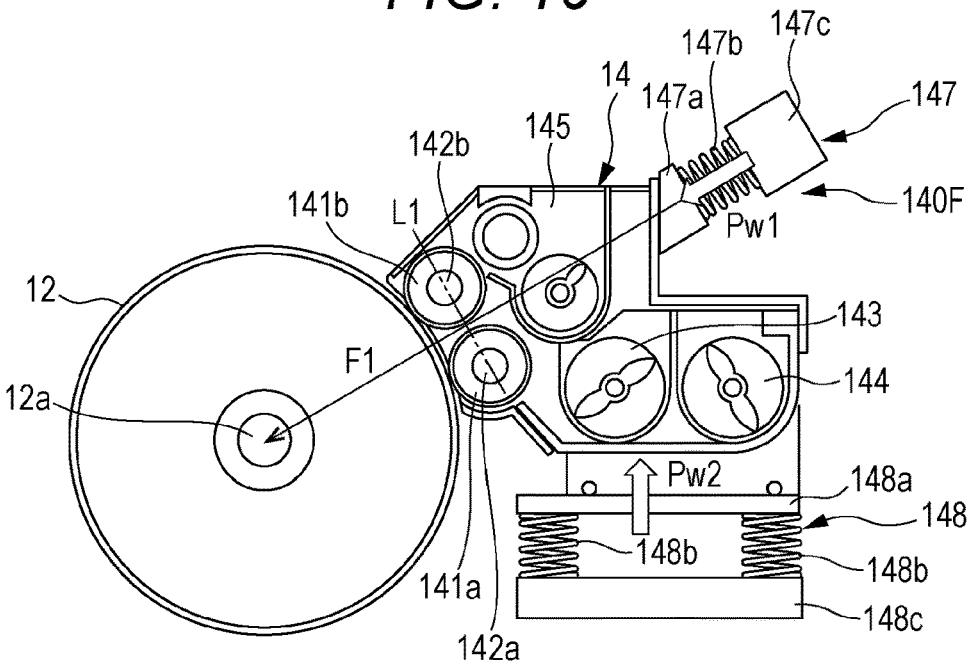
FIG. 10 is a schematic view showing a variation of the alignment mechanism of the developing device of the present embodiment.

FIG. 10 is a schematic view showing a variation of the alignment mechanism of the developing device of the present embodiment. In an alignment mechanism 140F shown in FIG. 10, an acting direction F1 of the first force Pw1 is substantially perpendicular to an imaginary line L1 through the shaft 142*a* of the first developer roller 141*a* and the shaft 142*b* of the second developer roller 141*b*, and is directed toward the shaft 12*a* of the photoconductor drum 12.

This enables the first developer roller 141*a* and the second developer roller 141*b* to be pressed toward substantially the center of the photoconductor drum 12 and suppresses dispersion of the first force Pw1 for abutting the first abutment members 146$a_L$, 146$a_R$, shown in FIGS. 3A and 3B, against the first abutted members 122$a_L$, 122$a_R$, and the second abutment members 146$b_L$, 146$b_R$ against the second abutted members 122$b_L$, 122$b_R$.

Figure 11:
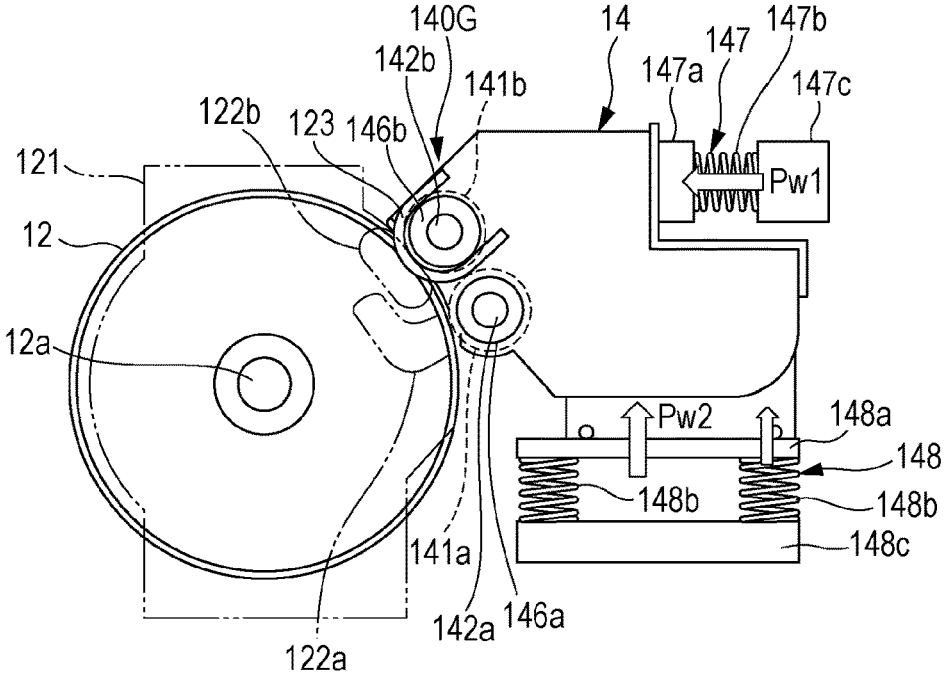
FIG. 11 is a schematic view showing a variation of the alignment mechanism of the developing device of the present embodiment.

FIG. 11 is a schematic view showing a variation of the alignment mechanism of the developing device of the present embodiment. An alignment mechanism 140G shown in FIG. 11 is provided, on one of the housings 121 of the photoconductor unit 120, with a guide 123 that supports any one of the first abutment members 146*a* and the second abutment members 146*b*, with this being one of the second abutment members 146*b* in the present example.

The guide 123 has a transverse width along the peripheral direction of the photoconductor drum 12 that is equal to the diameter of the second abutment member 146*b* and that extends toward the shaft 12*a* of the photoconductor drum 12. This restricts the movement of the one of the second abutment members 146*b* supported by the guide 123, along the peripheral direction of the photoconductor drum 12.

Thus, in the developing device 14, the first developer roller 141*a* and the second developer roller 141*b* are restricted from moving along the peripheral direction of the photoconductor drum 12. In addition, the developing device 14 is allowed to move by the first force Pw1 in a direction in which the first abutment member 146*a* abuts against the first abutted member 122*a* and the second abutment member 146*b* abuts against the second abutted member 122*b*.

This regulates the position of the developing device 14 with respect to the peripheral direction of the photoconductor drum 12 and ensures the alignment required during charge, exposure, and development of the photoconductor drum 12.

Figure 12:
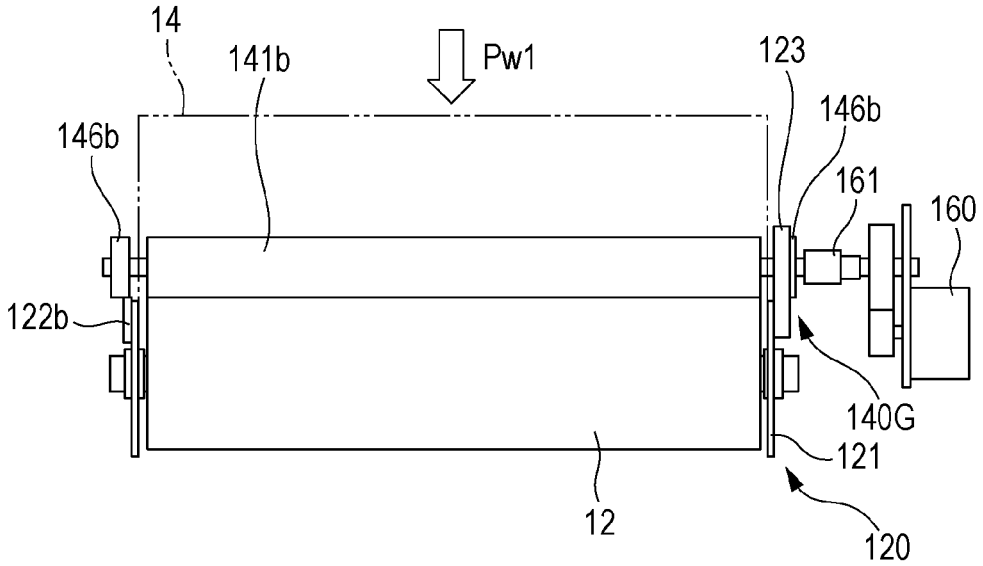
FIG. 12 is a schematic view showing a variation of the alignment mechanism of the developing device of the present embodiment.

FIG. 12 is a schematic view showing a variation of the alignment mechanism of the developing device of the present embodiment. An image forming apparatus provided with the alignment mechanism 140G described in FIG. 11 includes, on a side of the image forming apparatus, a driver 160 that drives, for example, the first and second developer rollers 141*a*, 141*b*, and the stirrer screw shown in FIG. 1, and the like, of the developing device 14, and on the housing 121 on the side on which the guide 123 is provided, a drive force inputter 161 that transfers a drive force from the driver 160 to the developing device 14.

In the developing device 14, the position of the one of the first abutment members 146*b* is regulated by the guide 123 so that misalignment between the drive force inputter 161 and the developing device 14 is suppressed, and movement of the abutment members away from the respective abutted members is suppressed due to the drive force transferred from the driver 160.

Figure 13:
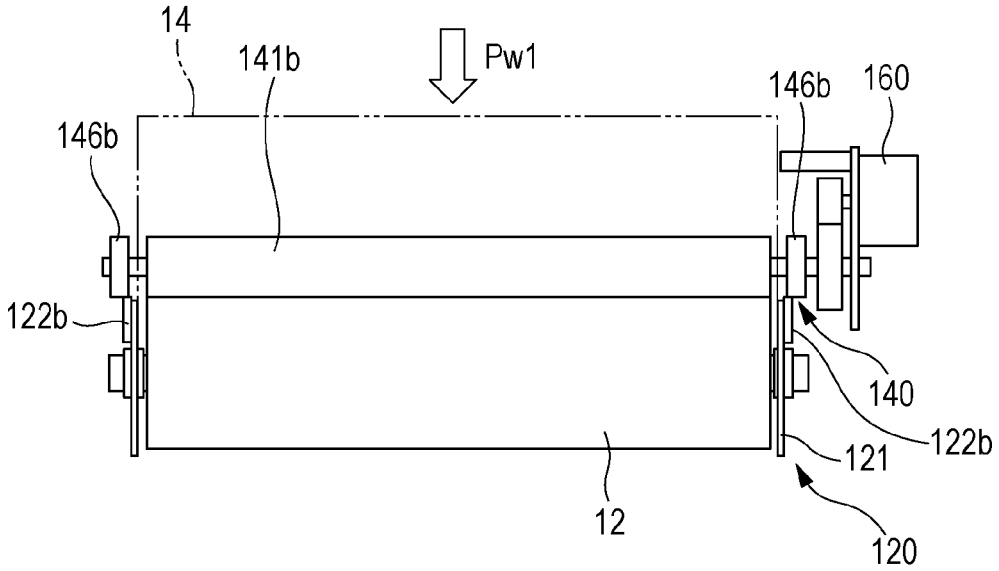
FIG. 13 is a schematic view showing a variation of the alignment mechanism of the developing device of the present embodiment.

FIG. 13 is a schematic view showing a variation of the alignment mechanism of the developing device of the present embodiment. An image forming apparatus provided with the alignment mechanism 140A described in FIGS. 2, 3A, and 3B, or an image forming apparatus provided with the alignment mechanisms 140B to 140G described in FIGS. 4 to 11 includes, on the developing device 14, the driver 160 that drives, for example, the first and second developer rollers 141*a*, 141*b*, and the stirrer screw shown in FIG. 1, and the like, of the developing device 14.

This prevents misalignment between the driver 160 and the developing device 14, and suppresses the movement of each of the abutment members away from the respective abutted members due to the misalignment of the developing device 14 relative to the driver 160.

The present invention is applicable to an image forming apparatus that transfers and fixes a toner image on a sheet of paper and forms an image, and an image forming system that includes a device for supplying sheets of paper to an image forming apparatus and a device for post-treating a sheet of paper on which an image is formed.

Although embodiments of the present invention have been described and illustrated in detail, it is clearly understood that the same is by way of illustration and example only and not limitation, the scope of the present invention should be interpreted by terms of the appended claims.

What is claimed is:

1. An image forming apparatus comprising:

a photoconductor drum;

a developing device having a plurality of developer rollers and supplying toner to the photoconductor drum, wherein the plurality of developer rollers are adjacent to the photoconductor drum;

a first pressing force applier that applies a force to the developing device to press the plurality of developer rollers toward the photoconductor drum; and a second pressing force applier that flexibly holds the developing device in a vertical direction, wherein the second pressing force applier includes a spring configured to apply a force to a mounting member on which the developing device is mounted.

2. The image forming apparatus according to claim 1, wherein the second pressing force applier flexibly holds the developing device by applying a force from vertically below a center of gravity of the developing device.

3. The image forming apparatus according to claim 1, wherein the second pressing force applier flexibly holds the developing device by applying, to the developing device, a first force from vertically below a center of gravity of the developing device and applying, to the developing device, a second force smaller than the first force in a direction parallel to the first force from the opposite side of the plurality of developer rollers with respect to the center of gravity of the developing device.

4. The image forming apparatus according to claim 1, wherein the mounting member is rotatably supported by a shaft on a side of the photoconductor drum and movably supporting the developing device in a vertical direction by a rotational operation about the shaft, wherein the second pressing force applier flexibly holds the developing device by applying a force to the mounting member from the opposite side of the plurality of developer rollers with respect to the center of gravity of the developing device.

5. The image forming apparatus according to claim 4, wherein the developing device is supported by the mounting member via a rotatable support member that rotates along a direction of movement of the developing device being moved by the force applied by the first pressing force applier.

6. The image forming apparatus according to claim 4, further comprising a stopper that restricts an amount of movement of the mounting member being moved by the force applied by the second pressing force applier.

7. The image forming apparatus according to claim 4, further comprising an adjuster that adjusts an amount of the force applied by the second pressing force applier.

8. The image forming apparatus according to claim 1, further comprising:

a support shaft provided at the center of gravity of the developing device for supporting the developing device; and the mounting member having a hole into which the support shaft is inserted, the hole enabling the support shaft to move along the direction of movement of the developing device being moved by the force applied by the first pressing force applier, the mounting member being rotatably supported by the shaft on the side of the photoconductor drum, wherein the second pressing force applier flexibly holds the developing device by applying a force to the support shaft.

9. The image forming apparatus according to claim 1, wherein the first pressing force applier applies a force to the developing device so as to move the plurality of developer rollers toward the photoconductor drum in a direction toward a shaft of the photoconductor drum.

10. The image forming apparatus according to claim 1, further comprising housings accommodating the photoconductor drum, wherein the developing device further includes a pair of abutment members, and the housings also accommodate a pair of abutted members to be abutted against the abutment members and a guide for regulating any one of the pair of abutment members to move along a peripheral direction of the photoconductor drum.

11. The image forming apparatus according to claim 10, wherein a drive force inputter for transferring a drive force, to the developing device, from a driver for driving the developing device is provided on at least one of the housings on a side on which the guide is provided.

12. The image forming apparatus according to claim 1, wherein the developing device includes a driver for driving the developing device.

13. The image forming apparatus according to claim 1, wherein the developing device includes two developer rollers.

14. The image forming apparatus according to claim 1, wherein the plurality of developer rollers includes a first developer roller and a second developer roller, the first developing roller includes a first shaft, and the second developer roller includes a second shaft that is substantially parallel to the first shaft.

15. The image forming apparatus according to claim 14, wherein an imaginary line passes through the first shaft and the second shaft, and the first pressing force applier applies the first pressing force in a direction that is substantially perpendicular to the imaginary line.

16. The image forming apparatus according to claim 15, wherein the direction, in which the first pressing force is applied by the first pressing force applier, is directed to a shaft of the photoconductor drum.

17. The image forming apparatus according to claim 1, wherein an imaginary line passes through the plurality of developing rollers, and the first pressing force applier applies the first pressing force in a direction that is substantially perpendicular to the imaginary line.

18. The image forming apparatus according to claim 17, wherein the plurality of developing rollers are pressed toward a center of the photoconductor drum.

19. The image forming apparatus according to claim 17, wherein the second pressing force applier includes a plurality of springs.

* * * * *